United States Patent [19]

Kulabukhov et al.

[11] 4,148,601

[45] Apr. 10, 1979

[54] FLEXIBLE CAM SYSTEM FOR ACTUATING MECHANISMS MOUNTED ON A REVOLVING ASSEMBLY

[75] Inventors: Vadim A. Kulabukhov, Moscow; Eduvard R. Allakhverdov, Tashkent; Boris A. Perlin, Tashkent; Grigory S. Shteinberg, Tashkent; Anatoly I. Afanasiev, Tashkentskaya oblast; Valentin V. Sheludko, Podolsk Moskovskoi oblasti; Boris I. Nudelman, Tashkent; Valery G. Volkov, Podolsk Moskovskoi oblast; Vasily F. Salomasov, Podolsk Moskovskoi oblasti; Jury V. Startsev, Podolsk Moskovskoi oblasti, all of U.S.S.R.

[73] Assignee: Gosudarstvenny Vsesojuzny Nauchno-Issledovatelsky Institut Tsementnoi Promyshlennosti, U.S.S.R.

[21] Appl. No.: 810,287

[22] Filed: Jun. 27, 1977

[30] Foreign Application Priority Data

Aug. 6, 1976 [SU] U.S.S.R. ..... 2397384

[51] Int. Cl.[2] ..... F27B 7/36

[52] U.S. Cl. ..... 432/109; 266/96; 74/568 FS

[58] Field of Search ..... 432/103, 104, 105, 109; 266/96; 74/568 R, 568 FS; 254/135 R, 139, 142, 143

[56] References Cited

U.S. PATENT DOCUMENTS

| | | | |
|---|---|---|---|
| 3,794,483 | 2/1974 | Rossi | 432/109 |
| 3,945,624 | 3/1976 | Rossi | 266/96 |
| 4,070,149 | 1/1978 | Rossi | 266/96 |

*Primary Examiner*—Louis J. Casaregola
*Attorney, Agent, or Firm*—Robert E. Burns; Emmanuel J. Lobato; Bruce L. Adams

[57] ABSTRACT

A flexible cam system characterized by the use of flexible guide tracks provided with balance weights attached thereto. The guide tracks are connected to a supporting frame through regulating drive mechanisms provided therefor and mounted on opposite sides of the frame. The drive mechanisms are connected respectively with one end of each of said guide tracks rigidly, and with the other end thereof, movably, through guide rollers fixed thereto.

6 Claims, 2 Drawing Figures

FLEXIBLE CAM SYSTEM FOR ACTUATING MECHANISMS MOUNTED ON A REVOLVING ASSEMBLY

BACKGROUND OF THE INVENTION

The present invention relates to a a flexible cam system for actuating mechanisms mounted on a revolving assembly, mainly on a rotary furnace provided with means for the delivery of air-steam-gas mixture under the layer of a bulk-material suspension being heat-treated therein.

The invention is intended to control a rotary furnace during rotation thereof by acting mechanically on various mechanisms, e.g. valves, drives of burners, etc., mounted on the furnace body, so as to provide a specified sequence of their operation determined by the requirements of a given production process.

The present invention can be used in the building-material industry, primarily in roasting cement clinker where the processed mix therefor is blended with chlorides, for the delivery of an air-steam-gas mixture to treat the granular cake suspension during the removal of said chlorides therefrom, and in roasting plain cement clinker for the delivery of an air-steam-gas mixture under the layer of the mix suspension being processed for intensive calcination thereof. In addition, the invention can be used for the delivery of air under the layer of a bulk material cooled in a pipe cooler after roasting in a furnace.

The invention can also be used elsewhere, e.g. in metallurgy, for reducing iron ore in rotary furnances wherein a gas-reducer is delivered under the ore layer, and in the chemical industry for some processes carried out in rotary furnaces.

As is known, the granular cake obtained from a cement mix containing chlorides is freed from these. To do this, the caked granules are suspended in the revolving furnace by the delivery thereinto, under the layer of said granules, of an air-steam-gas mixture. The delivery of the mixture is accomplished by means of burners fitted with suitable valves to control the flow of various gaseous agents used. The same type of burners is employed on rotary furnaces fitted for intensive calcination of cement mixes and for reducing iron ores. The gaseous agents used are delivered to the layer of the mix being treated in a sequence specified for a given process. To effect the required sequence of operations of the burners valves, use is made of various tracer means.

Know flexible cam device has a frame mounted on a carriage which runs on rails layed along a furnace assembly, which frame carries a suitable guide means. The working face of the guide means is oriented at right angles to the furnace body. The carriage with the frame thereon is connected to a drive of a special system whereby the frame is capable of following the axial movement of the furance.

This device, however, suffers from a number of disadvantages, among which are: a guide track which is costly to manufacture, a complex cam system to follow axial movements of the furnace, lack of adjustments on the entrance and exit portions of the guide track, and lack of place for additional guide tracks.

There is also known a cam device for actuating mechanisms mounted on a revolving assembly, having a supporting frame located about the mechanisms and guide tracks mounted on the frame indirectly through servodrives thereof. The frame has an annular shape and is mounted by means of supporting rollers on ring-shaped rails affixed on the body of the assembly.

Although it remedies some disadvantages of the above device, this cam device is complex in construction and creates some substantial extra load on the rotary-furnace body. If the rollers of the frame stick on rails which are layed on the furnace body, the mechanisms actuated by the cam device may be damaged. This device must be mounted with great accuracy, and its running and maintenance are cumbersome.

SUMMARY OF THE INVENTION

The primary object of the present invention is to provide for reliable operation of a cam device with considerable axial and radial displacements of a revolving assembly.

Another object of the invention is to provide a cam device which is simple in construction and convenient for handling.

These and other objects of the invention are attained in a cam device for actuating mechanisms mounted on a revolving assembly, having a supporting frame positioned at the place where the mechanisms are fixed on the revolving assembly mechanisms, and guide tracks attached to the frame through regulating drive mechanisms, wherein, according to the invention, the guide tracks are flexible and provided with balance weights attached thereto, and said regulating drive mechanisms are mounted on opposite sides of said supporting frame and respectively attached each to one end of each of said guide tracks rigidly, and to the other end thereof, movably, through guide rollers secured to these drive mechanisms.

Cables may be used as the guide tracks.

Conveyor bands may also be used as the guide tracks.

The use of flexible guide tracks provided with balance weights in a device according to the invention makes it possible for the device to follow axial and radial displacements of the revolving assembly and the controlled mechanisms mounted thereon.

The location of the regulating drive mechanisms on opposite sides of the frame facilitates a simpler mounting and adjustment of the guide tracks.

The guide tracks in the form of cables provide the necessary flexibility thereof and resistance to wear caused by the contact of the follower rollers of said controlled mechanisms of said revolving assembly, and also reliable operation at high temperatures of the furnace assembly.

The guide tracks in the form of conveyor bands provide for improved operating reliability without much wear thereof caused by the slippage of the follower rollers of the controlled mechanisms along the entrance and exit portions of the guide tracks, and also for uniform distribution of loads on the controlled mechanisms.

The novel features of the present invention consist in the following.

The introduction of flexible guide tracks provided with tensioning weights attached thereto, so that one end of each of the flexible guide tracks is connected to a respective regulating drive mechanism rigidly, and the other end thereof, movably, through guide rollers of the drive mechanisms, ensures reliable operation of the cam device, and facilitates its manufacture, installation and servicing.

The use of cables as the flexible guide tracks provides for a simple construction and reliable operation of a cam device at high ambient temperatures.

The use of conveyor bands as the flexible guide tracks also provides for a simple construction and reliable operation of a cam device, because wear of the guide tracks on the entrance and exit portions thereof caused by the contact friction of the follower rollers of controlled mechanisms is drastically reduced.

BRIEF DESCRIPTION OF THE DRAWINGS

The invention will become more apparent by reference to the following detailed description of an exemplary embodiment thereof taken in conjunction with the accompanying drawings. In the drawings.

DESCRIPTION OF THE PREFERRED EMBODIMENTS

Figure 2:
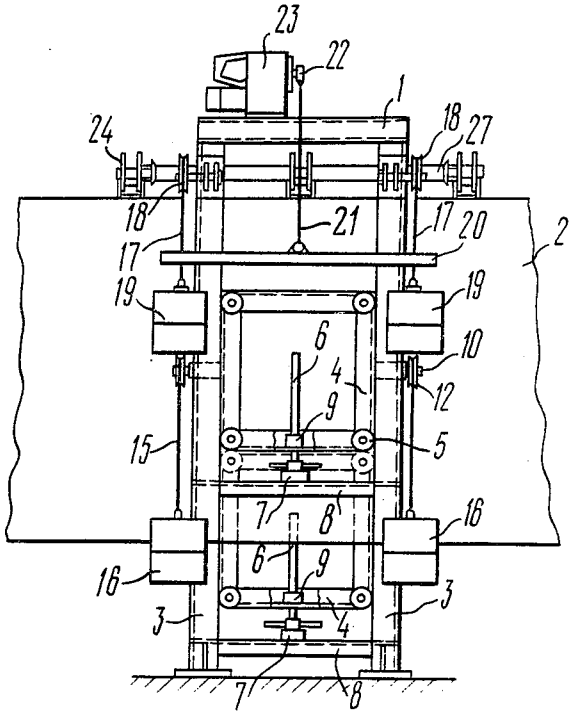
FIG. 2 is a side elevation view of the tracer device and a longitudinal view of the rotary furnace, with said controlled mechanisms mounted thereon being conditionally represented by one of the follower levers seen in FIG. 1.
Figure 1:
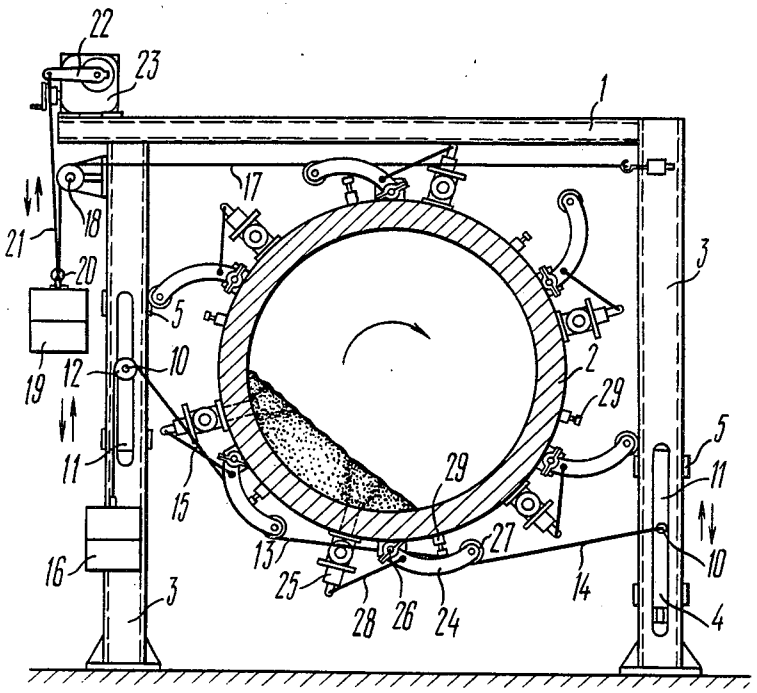
FIG. 1 is a front elevation view, partly in section, of a tracer device mounted on a rotary furnace, with controlled mechanisms mounted thereon.

Referring now to FIGS. 1 and 2, the tracer device has a supporting frame 1 made, for instance, in the form of channel-section rolled steel, which is positioned about a body 2 of a rotary furnace at the place where mechanisms to be actuated are mounted on the furnace body.

The frame 1 in this embodiment of the invention is made of channel-section rolled-steel bars. Vertical bars 3 make up rails in which are guidably mounted regulating drive mechanisms in the form of carriages 4 with rollers 5. The carriages 4 are provided with mechanisms for imparting movement thereto in a vertical plane, said mechanisms being composed of lead screws 6 mounted in support members 7 which are secured on a cross brace 8 between the vertical bars 3, and nuts 9 meshing with the lead screws 6, which are rigidly secured to the carriages 4. Side edges of the carriages 4 carry brackets with axles 10 which extend through suitable vertical slots 11 provided in the bars 3. The axles 10 carry thereon guide rollers 12. Parallel cables 13 form a bottom guide track. The ends of the cable 13 which form entrance portions 14 of the guide track are rigidly attached to the right-hand carriage 4. The ends of cables 13 which form exit portions 15 of the guide track carry balance weights 16 and rest on the guide rollers 12.

Two parallel cables 17 form a flexible top guide track. The cables 17 are stretched between the vertical bars of the frame 1 so that the right-hand ends of the cables are rigidly secured thereto, and the left-hand ends carry tensioning weights 19. The cables are guided on guide rollers 18 attached to the left-hand bars of the frame 1. The cables 17 are tied to each other by means of a beam 20 which is connected through a cable 21 to a lever 22 of a drive mechanism 23.

According to the present embodiment of the invention, the mechanisms under control comprise control levers 24 adapted to act on valves 25 normally closed by suitable springs incorporated therein (not shown in the drawings). The valves 25 are rigidly mounted in the body 2 of the rotary furnace and used to regulate the rate of flow of an air-steam-gas mixture delivered to the layer of the material being processed. The levers 24 are pivotally mounted on pins 26 and provided with rollers 27 in the form of tubular members whose length is 2.5 to 3 times the axial displacement of the frame 1. The levers 24 are connected to the valves 25 by means of links 28. The working travel of the levers 24 is limited by adjustable stop elements 29 suitably located on the body 2 of the rotary furnace. The bottom guide track serves to actuate the opening of the valves 25 as these pass by under the layer of the material being inside the furnace. The top guide track serves to actuate a periodic blasting of the valves 25 that come out of contact with the material in order to remove its particles therefrom.

The tracer device according to the invention operates as follows. The left and right-hand carriages 4 are set in position by turning the lead screws 6 so that the parallel cables 13 under the pull of the balance weights 16 press the levers 24 of the valves 25 that are underneath the layer of the material against the respective stop elements 29. The mass of the balance weights 16 is determined so as to overcome the pressure of the springs within the valves 25 and to press the levers 24 against the stop elements 29. As the furnace revolves clockwise (as shown in FIG. 1), the rollers 27 on the levers 24 engage the entrance portions 14 of the cables 13 and, owing to the ever decreasing clearance between the cables and the furnace, the levers 24 turn towards the furnace body 2, pull the links 28 and thereby gradually open the valves 25 that pass by under the layer of the material. Thereupon, an air-steam-gas mixture is injected into the layer of the material for suspension thereof. The levers remain pressed against the stop elements 29 on a certain length of the cables, and hence the valves 25 remain opened as much as is permitted by the position of the adjustable stop elements 29. As the furnace continues to revolve, the clearance between its body 2 and the exit portions 15 of the cables 13 gradually increases, and the levers 24 under the action of the valve springs are brought back to their initial position. The valves 25 are closed, stopping the delivery of the gaseous components to the material. When the length of the entrance portion 14 and the exit portion 15 of the bottom guide track and the time of the delivery of the gaseous components to the layer of the material being under treatment needs to be increased, the carriages 4 are lifted by the aid of their drive mechanisms. When the active length of the guide track needs to be reduced, the carriages 4 are lowered. For the complete withdrawal of the guide track from its working position, which is done, for instance, during the firing of the furnace or for stopping the delivery of gaseous agents to the material under treatment, the carriage 4 with the balance weights 16 is lowered until the latter engage some limiting surface (the furnace foundation, as exemplified in the drawings). As this happens, the cables slacken so that they cannot press the levers 24 against the stop elements 29. Since the left-hand ends 15 of the cables 13 are movably connected to the frame 1, radial displacements of the furnace body 2 or some misalignment of the levers 24 mounted thereon do not affect the guide track and the control mechanisms, which otherwise might be damaged. Here, the guide track follows the furnace radial displacements. Axial displacements of the furnace are compensated for by the rollers 27 which have an adequate length, as mentioned in the foregoing, and while moving together with the furnace body 2 relative to the cables 13, the rollers never lose contact therewith. The top guide track 17 operates on the same principle as the bottom one, only it is withdrawn from its working position by lifting some distance the balance weights 19. At this time, the lever 22 through the cable 21 moves the beam 20 upwards, which, in turn, lifts the weights 19. The top guide track is brought into action periodically for blasting the valves 25 in the upper position thereof on the furnace body 2. In the illustrated embodiment, the carriages 4 are driven manually by turning the lead screws 6.

It is possible to mount on the flexible cam system an electromechanical drive with remote control thereof, whereby the top guide track is automatically activated and the bottom guide track is automatically withdrawn. It becomes necessary in the case of emergency, for example, when the gaseous agents are shut off and the valves may be damaged by quantities of the material being processed which get thereinto. To exclude this, the valves that pass under the layer of material must be closed and then opened as they come out of contact therewith to allow their chambers to be emptied of some particles of the material, which go out by gravity.

During heat treatment of a cake obtained by roasting of a cement mix with chlorides, in the calcination of plain cement mixes, and in the cooling of clinkers, a flexible cam system according to the present invention can be used to actuate various control mechanisms secured to the body of a rotary furnace or cooler, e.g. burners, valves for the delivery of gaseous agents, electrical switches, etc.

A flexible cam system as hereinbefore particularly described is simple in construction and handling, reliable in operation, and consequently ensures reliable functioning of mechanisms actuated thereby, e.g. burners, valves, etc., which are mounted on rotary furnaces and which provide for efficient operation thereof characterized by a 1.5 to 2 times increase in output and a 10 to 30% reduction in specific fuel consumption.

What is claimed is:

1. In combination, a rotatably driven assembly having a plurality of cam-actuated mechanisms actuated sequentially during rotation of said assembly, cam follower means connected to said cam-actuated mechanisms for actuating said cam-actuated mechanisms, a flexible cam system for actuating said cam-actuated mechanisms comprising a frame, and flexible guide tracks each guide track secured to said frame rigidly at one end and having tensioning means at its opposite end, said guide tracks extending along certain paths travelled by said cam follower means during rotation of said driven assembly and engageable by said cam follower means during travel along said certain paths for actuating said cam-actuated mechanisms during travel along said certain paths.

2. The combination according to claim 1, in which said rotatably driven assembly comprises a rotary kiln, and in which said cam-actuated mechanisms comprise a plurality of spring-loaded valves actuated in a selected sequence and biased to a closed position.

3. The combination according to claim 2, in which said flexible tracks comprise tensioned cables, means for tensioning said cables, said cam follower means comprising cam followers and means connecting each cam follower to a corresponding one of said valves for opening the corresponding valve during engagement with said flexible tracks.

4. The combination according to claim 3, in which said tensioning means include means for variably tensioning said cables.

5. The combination according to claim 4, in which said tensioning means comprise weights connected to said cables variably positionable to vary the tension on a corresponding cable.

6. The combination according to claim 1, in which said flexible guide tracks comprise flexible tensioned cables, and including means to variably tension the cables.

* * * * *